US006122905A

United States Patent [19]

Liu

[11] Patent Number: 6,122,905

[45] Date of Patent: Sep. 26, 2000

[54] COMPRESSOR BLEED VALVE

[75] Inventor: Xiaoliu Liu, Mississauga, Canada

[73] Assignee: Pratt & Whitney Canada Corp., Longueuil, Canada

[21] Appl. No.: 09/023,217

[22] Filed: Feb. 13, 1998

[51] Int. Cl.[7] ..... F02C 9/18

[52] U.S. Cl. ..... 60/39.07; 60/39.29

[58] Field of Search ..... 60/226.1, 226.3, 60/262, 39.29, 39.07; 137/115, 116; 418/26, 27, 28; 251/123

[56] References Cited

U.S. PATENT DOCUMENTS

| | | | |
|---|---|---|---|
| 1,862,289 | 6/1932 | Anderson . | |
| 2,092,961 | 9/1937 | Eickstaedt . | |
| 2,375,411 | 5/1945 | Grant . | |
| 2,473,620 | 6/1949 | Teague, Jr. . | |
| 2,531,942 | 11/1950 | Lee . | |
| 2,645,244 | 7/1953 | Klickman . | |
| 2,693,904 | 11/1954 | Boyd . | |
| 2,702,665 | 2/1955 | Ledwith . | |
| 2,850,227 | 9/1958 | Wheatley . | |
| 3,108,767 | 10/1963 | Eltis et al. . | |
| 3,166,989 | 1/1965 | Cowles et al. . | |
| 3,360,189 | 12/1967 | Cook . | |
| 3,368,428 | 2/1968 | Shipley et al. . | |
| 3,398,928 | 8/1968 | Fredd . | |
| 3,688,504 | 9/1972 | Hutchinson et al. . | |
| 3,747,341 | 7/1973 | Davis . | |
| 3,777,489 | 12/1973 | Johnson et al. . | |
| 3,809,490 | 5/1974 | Harner . | |
| 3,849,020 | 11/1974 | Eastman . | |
| 3,898,799 | 8/1975 | Pollert et al. . | |
| 3,909,152 | 9/1975 | Rannenberg . | |
| 3,941,498 | 3/1976 | Duckworth et al. . | |
| 3,979,105 | 9/1976 | Pool et al. . | |
| 4,050,240 | 9/1977 | Vaught . | |
| 4,120,156 | 10/1978 | Melnerney . | |
| 4,280,678 | 7/1981 | Roberts . | |
| 4,344,282 | 8/1982 | Anders | 60/262 |
| 4,522,592 | 6/1985 | Johnson . | |
| 4,574,585 | 3/1986 | Conn . | |
| 4,590,759 | 5/1986 | Blizzard | 60/39.29 |
| 4,671,318 | 6/1987 | Benson . | |
| 4,702,070 | 10/1987 | Cureton et al. . | |
| 4,715,779 | 12/1987 | Suciu . | |
| 4,827,713 | 5/1989 | Peterson et al. . | |
| 4,886,416 | 12/1989 | Wunderlich . | |
| 4,998,562 | 3/1991 | Foltz . | |
| 5,261,228 | 11/1993 | Shuba . | |
| 5,279,109 | 1/1994 | Liu et al. . | |
| 5,477,673 | 12/1995 | Blais et al. . | |

FOREIGN PATENT DOCUMENTS

| | | |
|---|---|---|
| 680127 | 10/1952 | United Kingdom . |
| 847594 | 9/1960 | United Kingdom . |
| 950015 | 2/1964 | United Kingdom . |
| 2009854 | 12/1978 | United Kingdom . |

*Primary Examiner*—Charles G. Freay
*Attorney, Agent, or Firm*—Jeffrey W. Astle

[57] ABSTRACT

A bleed valve is in fluid communication with the compressor fluid flow path and the bypass fluid flow path whereby a piston extends radially of the valve and includes a piston head radially remote from the compressor fluid flow path. A pneumatic chamber surrounds a portion of the piston head, and air from a source downstream of the impeller is introduced into the chamber. The piston including a valving member and a rigid sleeve connecting the piston head to the valving means opens or closes the communication between the compressor flow path and the bypass flow path. A precompressed spring is associated with the piston to normally urge the piston radially outwardly relative to the compressor fluid flow path to a valve open position, and when the pneumatic pressure in the chamber surrounding the piston head overcomes the precompressed spring, the valve is closed.

4 Claims, 4 Drawing Sheets

COMPRESSOR BLEED VALVE

BACKGROUND OF THE INVENTION

1. Field of the Invention

The present invention relates to gas turbine engines, and particularly to a compressor bleed valve for improving the control of surge in such engines.

2. Description of the Prior Art

U.S. Pat. No. 3,809,490, Harner, issued May 7, 1974, describes the on-going problem of trying to avoid surge in gas turbine engines. The solution proposed over the years has been the provision of bleed valves to bleed off compressor air at different stages of the compressor. Thus, controls, mechanical or pneumatic, are provided for anticipating a surge condition by causing the valves to be opened to thereby bleed off air before a surge condition is to happen. Thus, in high power requirement conditions, the bleed valves are maintained closed, but during low power, the bleed valves are opened.

A pneumatic bleed valve is also described in U.S. Pat. No. 5,477,673, Blais et al., issued Dec. 26, 1995. This patent describes a bleed valve in the form of a piston extending radially through a bypass flow path, and operable to bleed compressor air into the bypass flow path when the piston type valve is open. The valve may be closed when air from a source downstream of the compressor impeller is fed to the head of the piston and such air is at a higher pressure than air from a downstream stage of the compressor. The pneumatic force to close the valve acts against a spring normally urging the valve to an open position.

As the engine speed changes from low to high, the bleed valve moves from an open to a closed position gradually. If during this transition the opening becomes too small, the engine may he in a surge condition.

SUMMARY OF THE INVENTION

It is an aim of the present invention to provide an improved pneumatic valve of the type described in U.S. Pat. No. 5,477,673 that includes a means for maintaining the bleed valve open with a larger bleed opening during gradual closing of the bleed valve during pneumatic control of the valve.

It is an aim of the present invention to provide a precompressed spring on the piston forming the operable portion of the valve.

In a gas turbine engine including a compressor and a bypass fluid flow path concentric with the compressor fluid flow path, there is a bleed valve in fluid communication with the compressor fluid flow path and the bypass fluid flow path whereby a piston extends radially of the valve and includes a piston head radially remote from the compressor fluid flow path, a pneumatic chamber surrounding a portion of the piston head and means for introducing compressed fluid into said chamber, the piston including a valving member and a rigid member connecting the piston head to the valving means whereby the piston is effective to open or close the communication between the compressor flow path and the bypass flow path, and a precompressed spring associated with the piston to normally urge the piston radially outwardly relative to the compressor fluid flow path to a valve open position whereby to close the valve, the pneumatic pressure in the chamber surrounding the piston head must overcome the precompressed spring.

In a more specific embodiment of the present invention, the spring is precompressed to 40 lbs.

It has been found that by precompressing the spring in the bleed valve described in U.S. Pat. No. 5,477,673, significant improvement can be obtained in avoiding possible engine surging by maintaining the bleed valve open longer and especially maintaining a larger opening of the bleed valve until the surge conditions are passed and the valve can definitely close.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
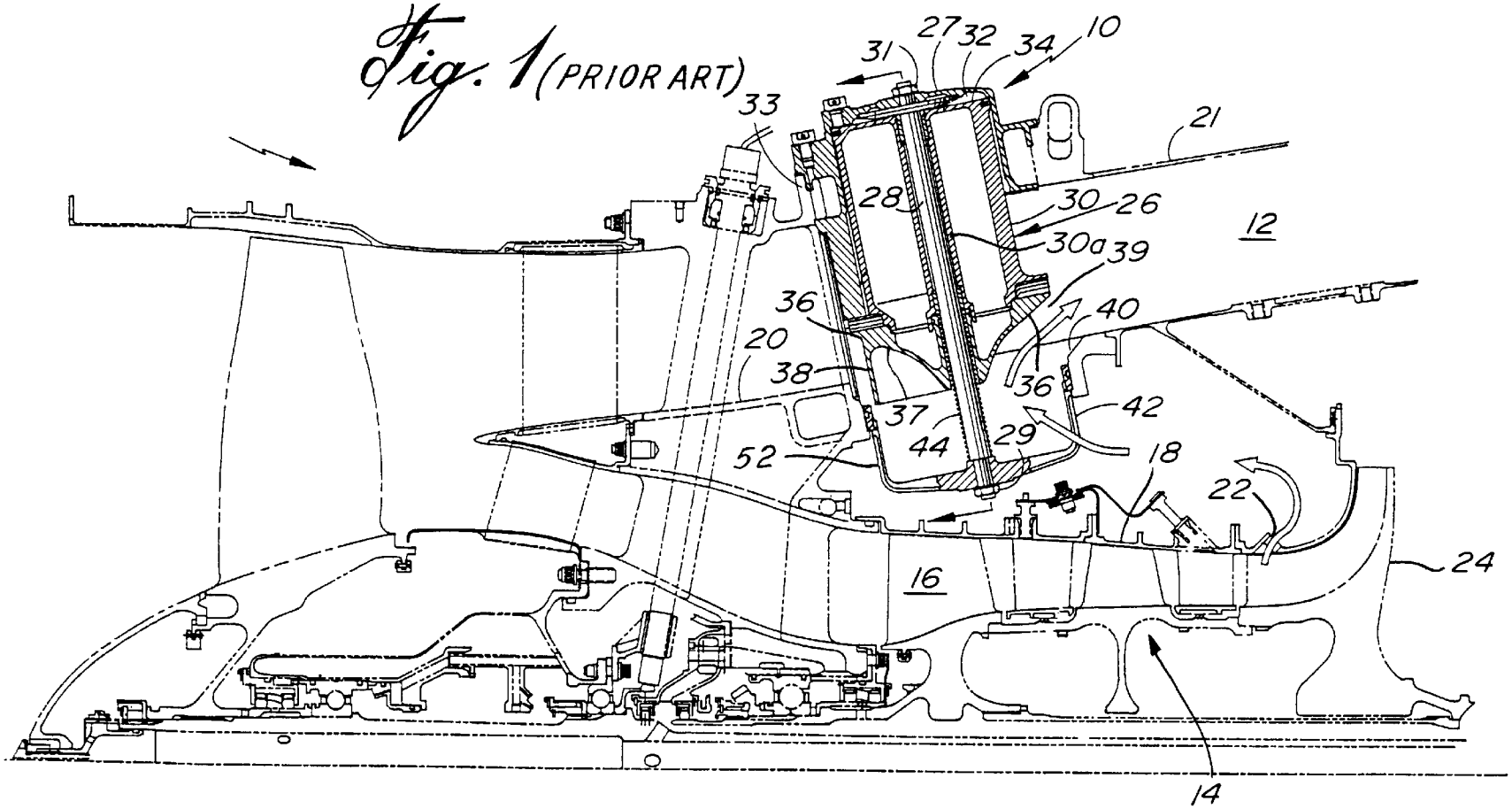
Fig. 1 (PRIOR ART)
FIG. 1 is an axial cross-section of a compressor portion of a gas turbine engine shown in dotted lines and illustrating in cross-section a bleed valve in accordance with the prior art in an open position.

Referring now to the drawings and particularly to FIG. 1, a bleed valve 10 is shown mounted in a compressor section 14 of a gas turbine engine having a bypass fluid flow path 12. The bleed valve 10, shown in FIG. 1, is according to U.S. Pat. No. 5,477,673, Blais et al., which is herewith incorporated by reference. As shown in FIG. 1, the compressor section includes a fluid flow path 16 which is somewhat concentric with the bypass fluid flow path 12. The compressor includes a downstream compressor stage outlet port 22 in shroud 18, adjacent the centrifugal impeller 24.

The bleed valve 10 is a piston type bleed valve having a closed casing with a piston 26 and a guide rod 28 fixed to the upper chamber housing 27 which defines a closed chamber 32. A piston head 34 slides within the chamber 32 in sealing relationship. The piston 26 includes a sleeve 30 and 30*a* which slides on the rod 28. The rod 28 is connected to the chamber housing 27 by means of a nut 31. The rod 28 is connected at its other end to the valve chamber housing 52 by means of nut 29. The valve chamber 52 is in the form of an open basket with openings 42. The valving element 36 includes a frusto-conical surface 37 and a partial cylindrical skirt 38 defining an opening 39 which corresponds with opening 40 in the bypass fluid flow inner wall 20.

As described in U.S. Pat. No. 5,477,673, the bleed valve, when in an open position as shown in FIG. 1, allows bleed air from the downstream portion of the compressor to pass through openings 42 and through opening 40 to the bypass fluid flow path 12 downstream of the bleed valve 10. The spring 44 normally urges the valve to its open position, as shown in FIG. 1, and the valve is closed pneumatically as described in the above United States patent.

It has been found that the valve, under the pneumatic pressure from a source downstream of the compressor impeller, as described in the above-mentioned patent, will prematurely close the valve against the spring 44 while the engine is still vulnerable to a surge condition.

Figure 2:
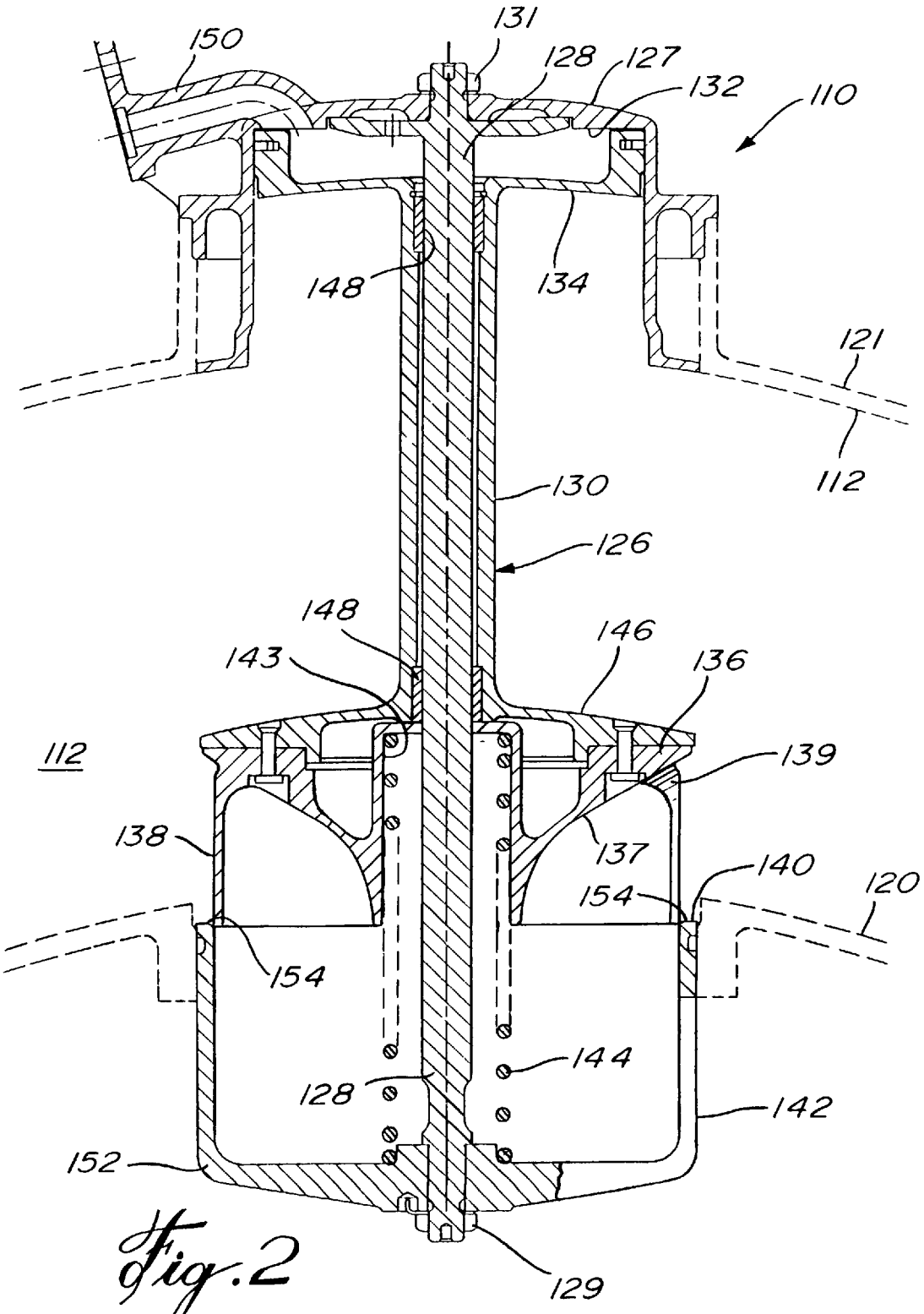
FIG. 2 is a cross-section taken in a vertical plane of the bleed valve in accordance with the present invention in an open position.
Figure 3:
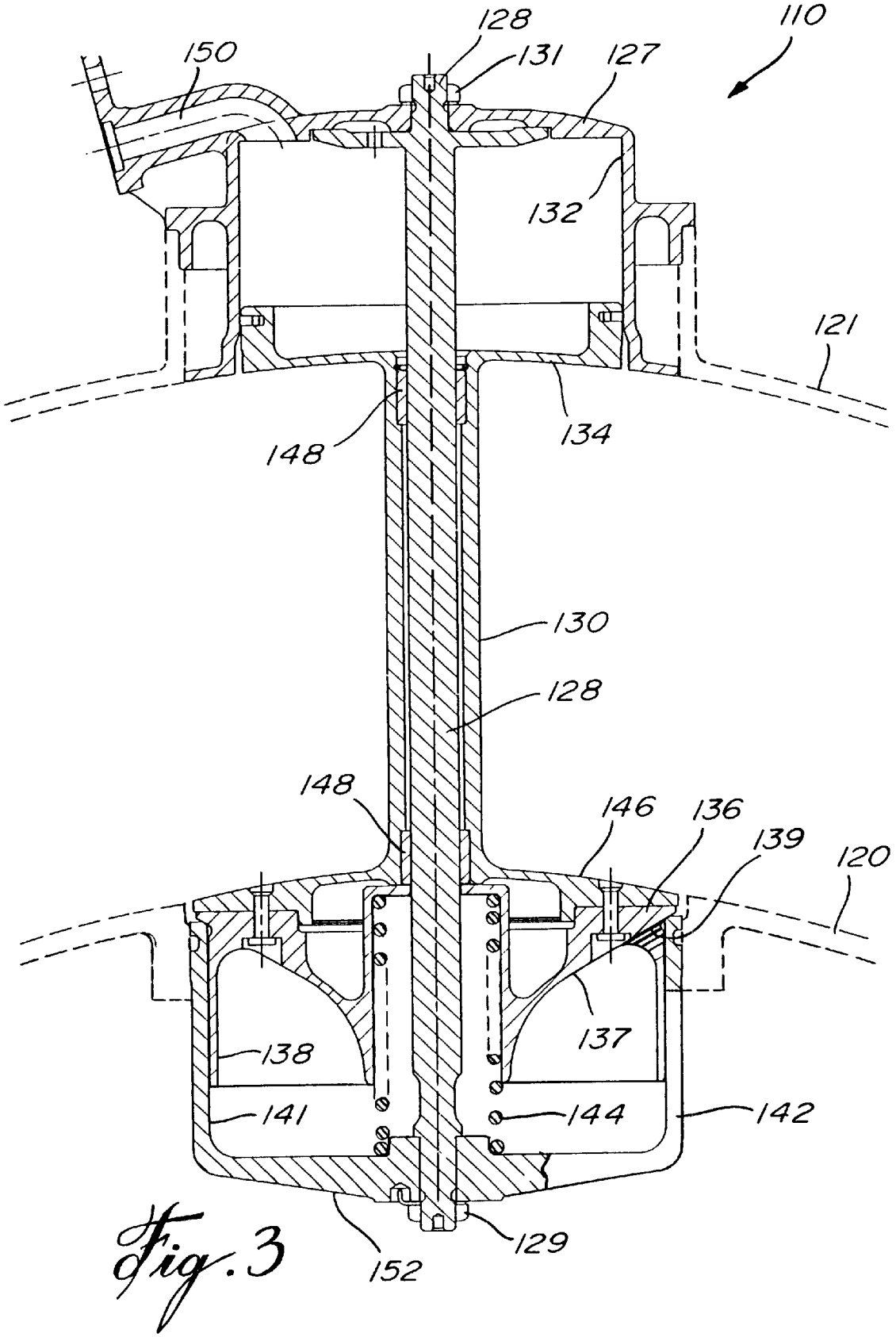
FIG. 3 is a cross-section, similar to FIG. 2, showing the bleed valve of the present invention in a closed position.

Referring now to FIGS. 2 and 3, the bleed valve, in accordance with the present invention, is shown and identified as 110. All of the reference numerals which correspond to reference numerals in FIG. 1 have been raised by 100.

The bleed valve 110 of FIGS. 2 and 3 is shown in cross-section in a radial plane, that is, at 90° to the cross-section of FIG. 1.

The bleed valve 110 includes an upper casing 127 defining a piston chamber 132 communicating with an inlet 150. Bleed valve 110 is a piston-type bleed valve and includes a piston 126 which includes the sleeve 130 having bushings 148 sliding on rod 128. Rod 128 is fixed at the casing 127 by means of nut 131. At the other end, rod 128 mounts a valve housing 152 in the form of an open basket which defines a valve seat 154 adjacent the inner wall 120 of the bypass fluid flow path 112.

The sleeve 130 mounts a piston head 134 which is adapted to slide in sealing engagement within the chamber 132. At the other end of the sleeve 130 is an aerodynamic cap 146 to which is connected a valving element 136. The valving element 136 includes a frustoconical surface surrounded partially by a skirt 138 which is adapted to slide within the basket 147 The valving element 136 defines an annular spring recess 143 which houses a coil spring 144. The skirt 138 defines an opening 139 in the downstream side of the valving element 136 (although the opening 139 is shown to one side in FIGS. 2 and 3 for the purposes of illustration only).

Figure 4:
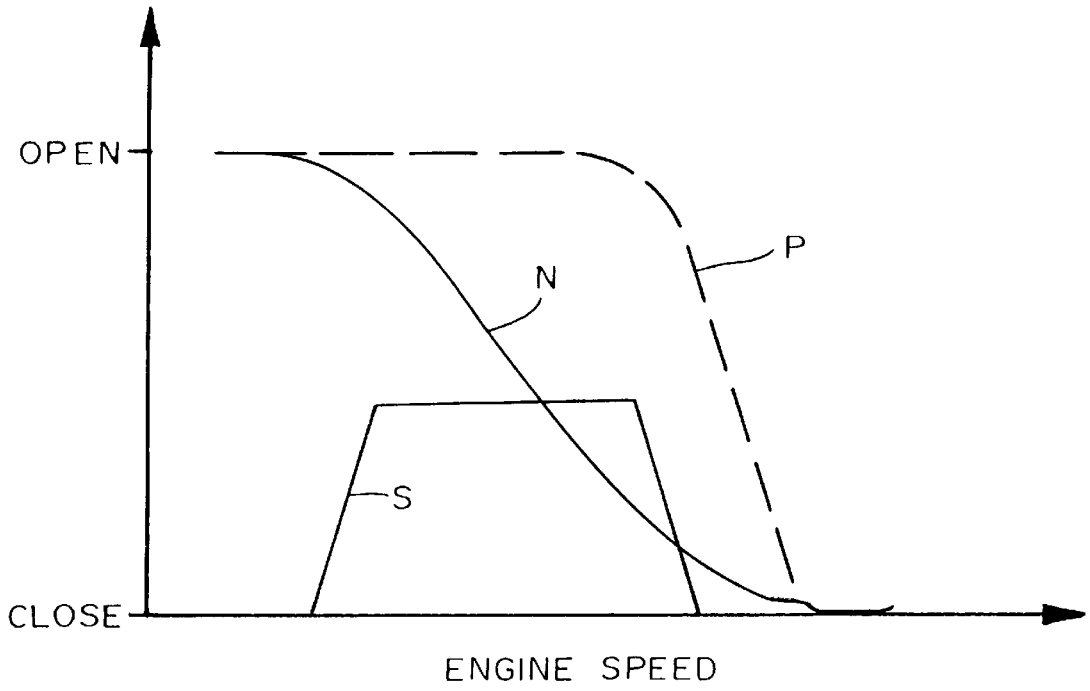
FIG. 4 is a graph illustrating the operating schedule of the bleed valve in accordance with the present invention compared with a prior art bleed valve.

Referring to FIG. 4, the curve N represents the bleed valve as shown in FIG. 1 of the spring 44. Thus, it can be seen that curve N, as it is closing, passes through the so-called surge bucket S. As the valve 36 is being closed, it is difficult to control the valve opening.

It has been found, however, that by precompressing the spring 144, as shown in FIGS. 2 and 3, the air pressure entering inlet 150 in FIG. 2 required to urge the piston head 134 and thus the piston 126 to close against the valve seat will need to be higher since the precompressed spring 144 offers more resistance. Since the necessary force required to overcome the spring 144 will be greater, the valve will remain open longer and will naturally be larger since the valving member will not readily close the opening unless a larger force is applied.

The curve P shown in FIG. 4 represents the schedule for closing valve 136 using a precompressed spring 144.

It has been found that a preferred spring rating will include a precompression of 40 lbs. when the valve is completely opened, although a precompression of 20 lbs. should be sufficient to clear the surge bucket. This compares to zero compression in terms of spring 44 in FIG. 1 when the valve is completely opened. It is anticipated that the spring could also be precompressed to 50 lbs. It is noted that when the valve 36 is closed, the spring 144 is compressed to 60 lbs. which is similar to the spring 44 in FIG. 1.

I claim:

1. In a gas turbine engine including a compressor with an axial fluid flow path, a bypass fluid flow path concentric with the compressor fluid flow path, a bleed valve in fluid communication with the compressor fluid flow path and the bypass fluid flow path whereby the bleed valve comprises a piston extending radially, with a piston head radially remote from the compressor fluid flow path, a pneumatic chamber surrounding a portion of the piston head and means for introducing compressed fluid into said chamber, the piston including a valving means and a rigid member extending between the piston head and the valving means whereby the piston is effective to open or close the communication between the compressor fluid flow path and the bypass fluid flow path, the improvement including a precompressed spring, precompressed to between 20 and 50 lbs., associated with the piston to normally urge the piston radially outwardly relative to the compressor fluid flow whereby the pneumatic pressure in the chamber surrounding the piston head must overcome the precompressed spring in order to close said valving means whereby the precompressed spring controls the closing schedule of the bleed valve to avoid the surge conditions of the engine.

2. The bleed valve as defined in claim 1, wherein the spring is precompressed to 40 lbs.

3. The bleed valve as defined in claim 1, wherein the bleed valve includes a casing defining the pneumatic chamber mounted to the outer shroud of the bypass fluid flow path and a valving means housing is mounted to the other end of a rod fixed to the chamber casing whereby the valving means housing is mounted to the inner wall of the bypass fluid flow path, the piston includes the piston head and an elongated sleeve connecting the piston head to the valving element such that the sleeve slides on the rod between a valve opened position and a valve closed position and the precompressed spring is mounted in the valving element housing between the valving element and the housing so as to urge the piston and the valving element to an open position.

4. The bleed valve as defined in claim 3, wherein the spring is precompressed to 40 lbs.

* * * * *